United States Patent [19]

Novoa

[11] Patent Number: 4,841,707

[45] Date of Patent: Jun. 27, 1989

[54] COMPOSITE DOUBLE OR MULTIPLE WALL

[76] Inventor: Jose M. Novoa, 350 W. Park Dr., Apt. 102, Miami, Fla. 33172

[21] Appl. No.: 689

[22] Filed: Jan. 5, 1987

[51] Int. Cl.[4] ..... F04B 2/00

[52] U.S. Cl. ..... 52/426; 52/562; 52/566; 52/275

[58] Field of Search ..... 52/562, 565, 426, 434, 52/435, 227, 425, 427, 424, 221, 568, 566

[56] References Cited

U.S. PATENT DOCUMENTS

| | | | |
|---|---|---|---|
| 1,343,926 | 6/1922 | Madsen | 52/258 |
| 1,449,496 | 3/1923 | Clifton et al. | 52/425 |
| 1,785,067 | 12/1930 | Bemis | 52/562 X |
| 1,887,132 | 11/1932 | Houghton | 52/424 X |
| 1,899,454 | 2/1933 | Bemis | 52/434 |
| 2,014,315 | 9/1935 | Egloff et al. | 52/424 X |
| 2,316,668 | 4/1943 | Bronner | 52/434 X |
| 2,366,752 | 1/1945 | Reichert et al. | 52/562 |
| 2,372,038 | 3/1945 | Westveer | 52/562 X |
| 2,387,431 | 10/1945 | Du Laney | 52/434 |
| 3,603,052 | 9/1971 | Novoa | 52/257 |
| 3,618,279 | 11/1971 | Sease | 52/227 |
| 4,015,397 | 4/1977 | Flachbarth et al. | 52/221 X |
| 4,433,520 | 2/1984 | Maschhoff | 52/426 X |

FOREIGN PATENT DOCUMENTS

| | | | |
|---|---|---|---|
| 804957 | 5/1951 | Fed. Rep. of Germany | 52/425 |
| 1076879 | 11/1954 | France | 52/425 |

*Primary Examiner*—Carl D. Friedman

[57] ABSTRACT

In the construction arrangement of building composite double or multiple walls, two or more load-bearing walls are built together by means of panels which are prefabricated of concrete or other strong hardenable material and of noncorrodible molds of various shapes that can be combined in various ways and which remain integrated in the final construction assembly. All the elements of the construction are of such size and weight that can be easily handled by two laborers without the need of special or heavy equipment. The separation between walls is pre-determinable in accordance with the specifications of the construction and the space between walls is fillable with any material suited to the purpose of the construction, which remains fireproof regardless the material used as filler. The composite walls can be fabricated with capability for bearing permanent overloads.

4 Claims, 7 Drawing Sheets

FIG. 24
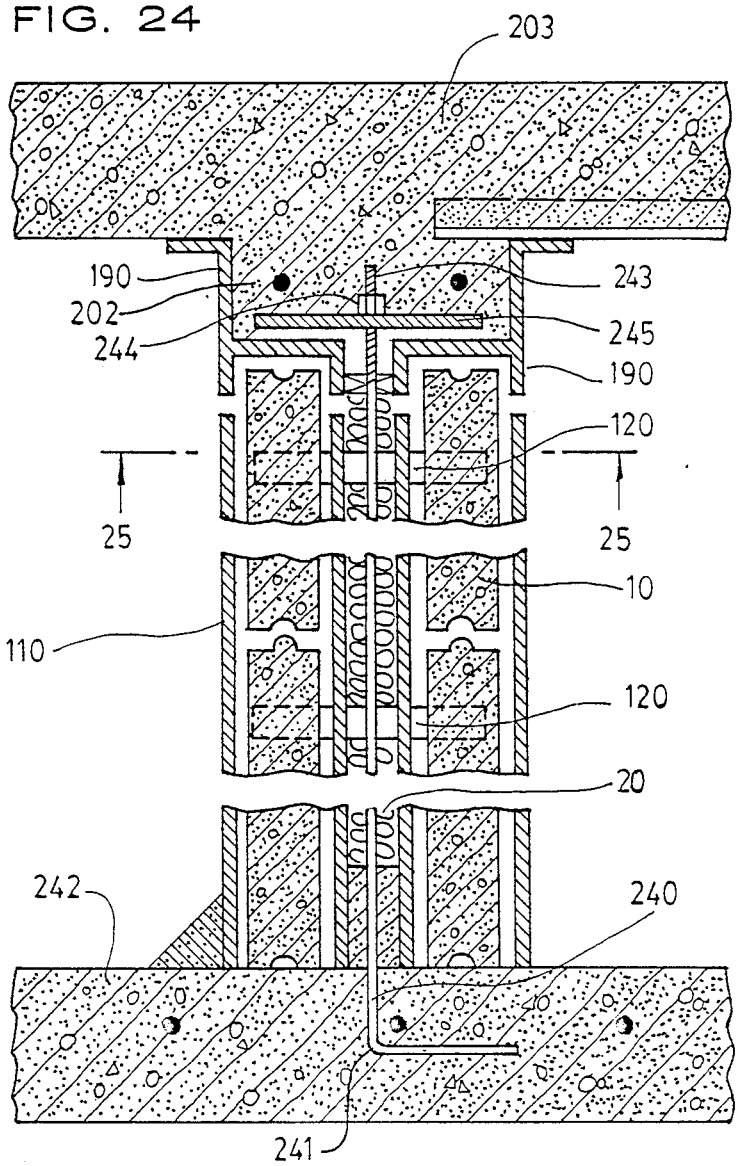
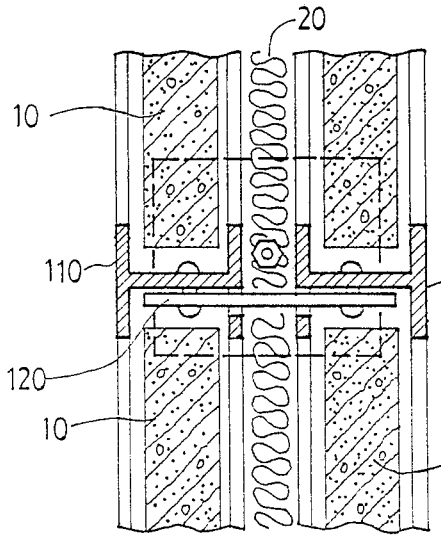
FIG. 25

COMPOSITE DOUBLE OR MULTIPLE WALL

BACKGROUND OF THE INVENTION

The invention relates to arrangements of the construction of concrete walls and particularly to construction of composite walls made of double or multiple single walls with empty or usable space between single units, the walls made of partially prefabricated and prefabricated parts.

In the conventional arrangement of erecting walls most of the construction elements are made on the construction site while the erection of the wall is carried on. It is known that this arrangement is costly and not too efficient because preparation of molds, time for setting of the concrete in the molds, or of mortar used in columns, beams, etc., cannot be considered a really productive time, during which inevitable costs are involved such as wages and material which become scrap after the construction has been finished. Furthermore, the individual work performed at the construction site is more expensive than the use of certain prefabricated and standardized parts.

It is also known in the trade that a single concrete wall does not provide adequate insulation when used in a building for housing and it normally requires the application, in the inside face of the wall, of insulating materials covered with drywall or the like that weaken the interior surface of the wall and make it a fire hazard.

In other concrete wall applications, such as bearing walls, noise barriers, retaining walls, anti-terrorist barriers, safety walls for correctional institutions, core walls for reservoirs, training walls in river beds, and the like, the construction process is generally cumbersome, slow and costly for the reasons mentioned above.

On the other hand, the erecting of walls by using exclusively prefabricated parts is subject to certain disadvantages practically insurmountable, particularly both in transportation and handling, which usually require special equipment. In addition, to withstand handling and transportation, large prefabricated panels require more reinforcing steel integrated in the panels than otherwise required for structural purposes alone.

This invention has been made to solve these and similar problems through the use of composite double or multiple walls constructed with simple, easy to handle elements.

SUMMARY

The invention consists in such novel features, construction arrangements, combination of parts and improvements as may be shown and described in connection with the apparatus herein disclosed by way of example only, and as illustrative of a preferred embodiment. The advantages of the invention are qualitative improvements of construction component parts, improved and expeditious handling of such parts and time-saving prefabrication of some of such parts and fabrication of other such parts in the construction site itself in order to fabricate composite walls made of two or more single walls, with pre-determinable separation between walls, resulting in a construction of great structural strength and relatively light weight.

The composite wall is designed so as to absorb structurally its maximum gravitational strength without the need of using reinforcing material integrated into the concrete panels of which the walls are constructed. The flanges in the columns of the wall, between which the panels are inserted, are sufficient to keep the panels in their vertical position, preventing the shear effect that otherwise might crack the panels prematurely. The anchorage of the columns absorbs the forces perpendicular to the wall.

The construction is of reduced cost because of the ability to use the space between walls for placing insulation or sealant materials or concrete or hazardous waste or any other material adequate to the purpose of each specific construction.

A further object of the invention is to provide for molds for fabrication of construction parts for composite walls, which molds are noncorrodible and constitute integral members of such parts.

Furthermore, it is an object of the invention to provide facilities for constructing of composite walls for substantially reducing the time required for the constructing and erecting work of the wall.

Various further and more specific purposes, features and advantages will clearly appear from the detailed description given below taken in connection with the accompanying drawing which forms part of this specification and illustrated merely by way of example one embodiment of the device of the invention.

BRIEF DESCRIPTION OF THE DRAWING

In the following description and in the claims, parts will be identified by specific names for convenience, but such names are intended to be as generic in their application to similar parts as the art will permit. Like reference characters denote like parts in the several figures of the drawing, in which

FIG. 24 is a section of a composite double wall showing a post-tensioning arrangement in the area of the wall where the connecting metal piece is used.

FIG. 25 is a cross section of the post-tensioning arrangement taken along line 25—25 of FIG. 24.

DESCRIPTION OF THE PREFERRED EMBODIMENT

Figure 1:
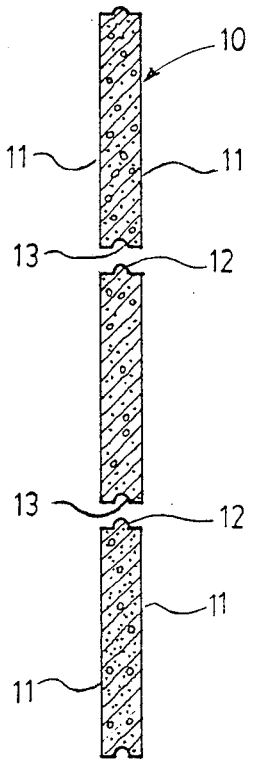
FIG. 1 is a sideview of three wall panels in the superimposed position in which they form a basic single wall section.

Referring now in more detail to the drawing illustrating a preferred embodiment by which the invention may be realized, there is shown in FIG. 1 a portion of a single wall consisting of prefabricated panels 10 which are conveniently fitted together. Each one of panels 10 is made of concrete or the like hardenable noncombustible material which becomes solid and strong after setting. The panel is manufactured by pouring concrete in a metal mold so that the panel walls 11, after the hardening of the concrete and the panel having been removed from the mold, have a smooth finish making unnecessary the use of stucco or plaster before painting them. The interlocking tongue and groove 12 and 13 arrangement of the panels is positioned in a manner that, when panels 10 are assembled for forming a wall, no water can penetrate through the seams, not even in the case of a strong storm.

Figure 2:
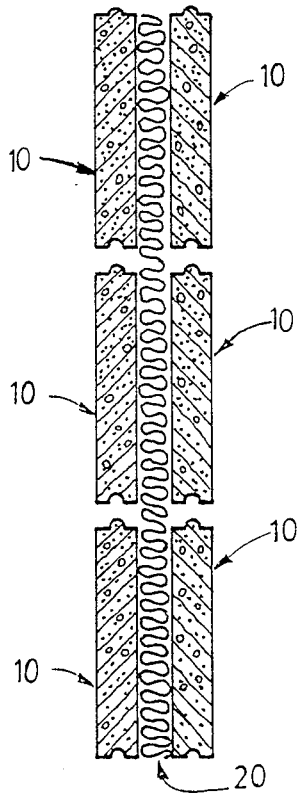
FIG. 2 is a sideview of a double wall with confined insulation, consisting of two walls made of prefabricated panels of a size small enough not to require reinforcement or special machinery for handling, and any type of insulation as it may be required.
Figure 3:
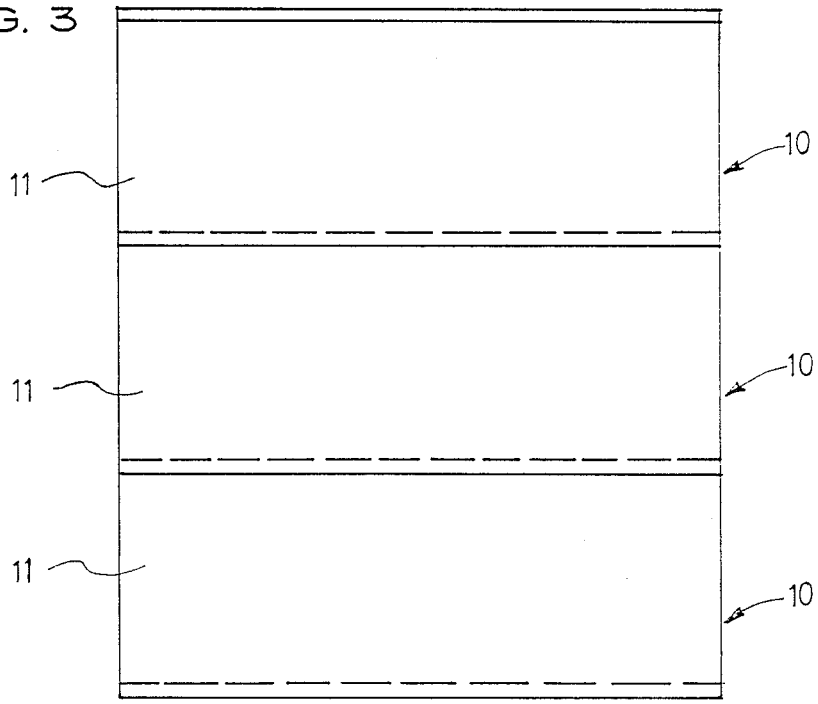
FIG. 3 is a front view of the composite double wall section shown in FIG. 2.

Shown in FIGS. 2 and 3 is a composite double wall made of panels 10 and insulation 20 which is confined within the wall, becoming thus incombustible.

Figure 4:
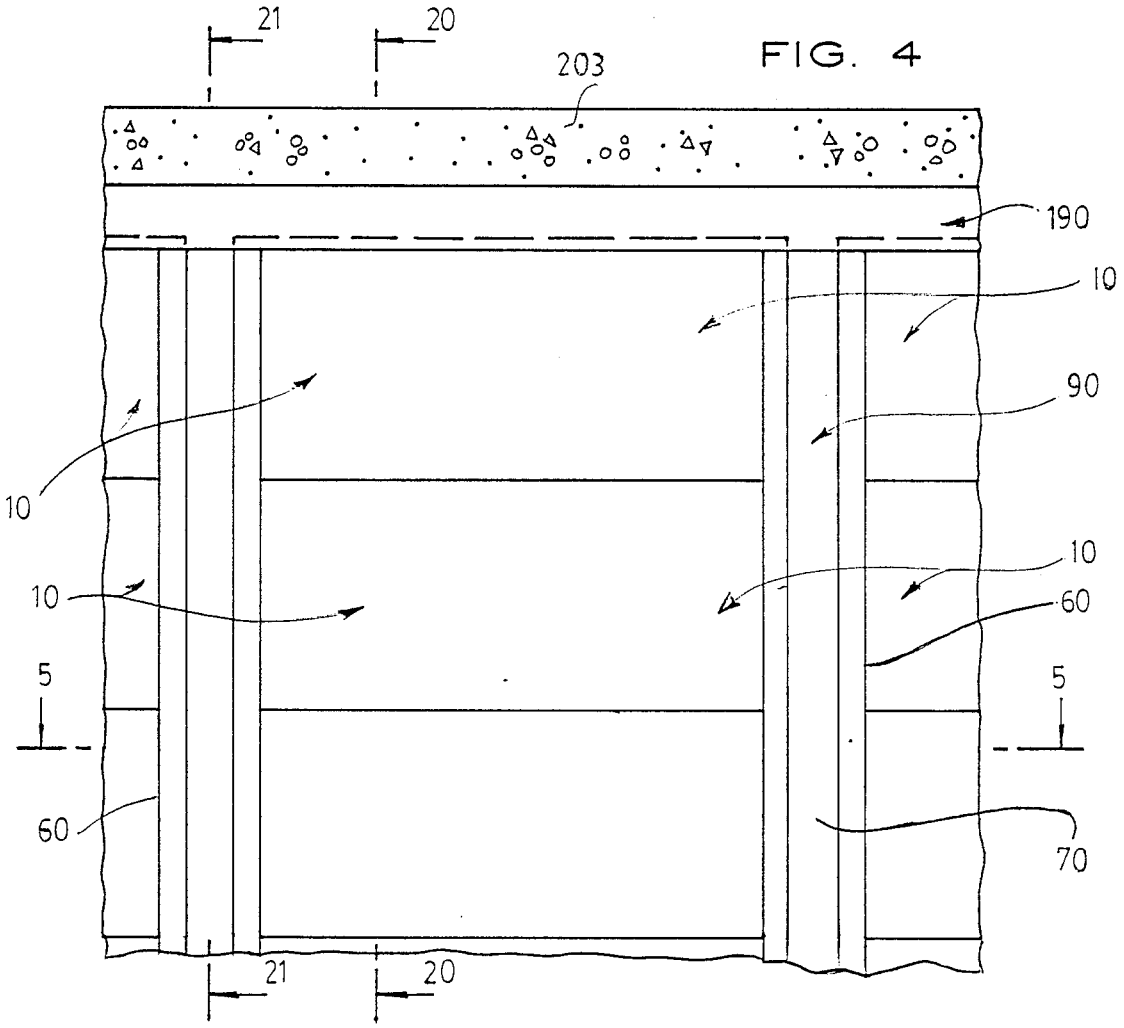
FIG. 4 is a front view of a composite double wall section in FIG. 3 with columns and beam joining the same.
Figure 5:
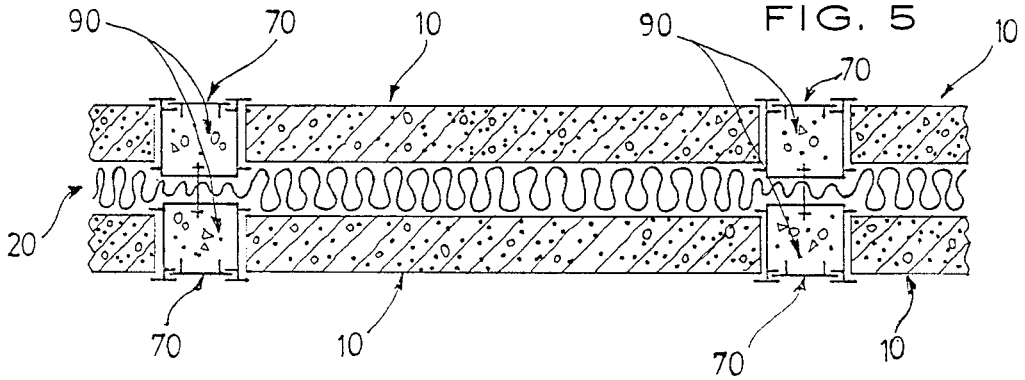
FIG. 5 is a section of the front view shown in FIG. 4 taken along the line 5—5.

FIG. 4 presents a front view of the composite wall showing the general arrangement of panels 10, composite columns 90, beams 190 and roof 203. FIG. 5 is a section along line 5—5 of FIG. 4 view showing the arrangement of panels 10, insulation 20, and composite columns 90.

Figure 6:
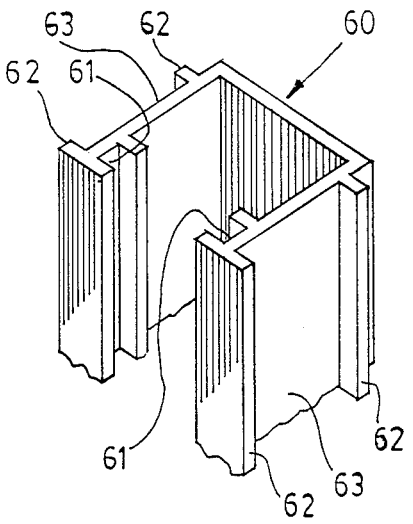
FIGS. 6 and 7 are isometric views of portions of two different mold pieces for fabricating or building columns.
Figure 7:
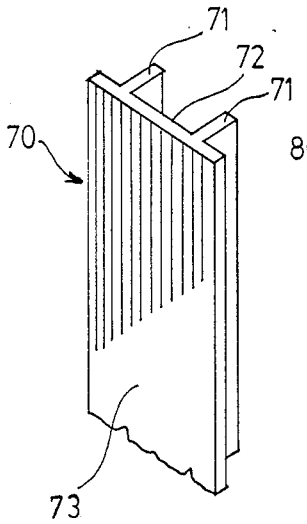
Figure 8:
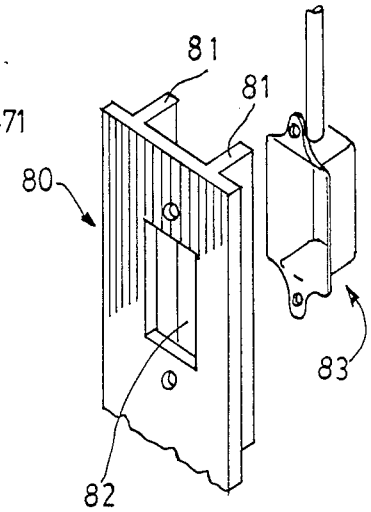
FIG. 8 is an isometric view of a variation of mold piece shown in FIG. 7 used in columns that are provided with electrical outlets or switches.

Shown in FIGS. 6, 7 and 8 are isometric views of molds 60, 70 and 80 for parts of which columns are made, which can be composed for fabricating various kinds of columns on the construction site. Mold piece 60 is the basic element for the standard column and is made of extruded aluminum or any other appropriate noncorroding material. Mold piece 70, made of the same material, is manufactured in sections of a length substantially equal to half the height of the column or any other convenient length consistent with the requirements of the erection process as per following description: Mold pieces 70 are the cover of the front side of the column. They are put in their place by sliding them from the end of the column along grooves 61 of mold piece 60. Thus loosely preassembled, the column is placed in its final position in a predetermined place on the floor slab. After the lower section of mold piece 70 rests by its edge on the floor slab, the lower half of the column is filled with concrete by any appropriate means, such as using a concrete pump, or gunite or the like. To allow for the passage of the nozzle of the concrete-applying device so that it can be positioned on top of the section in order to fill the lower half of the column, the upper section of mold piece 70 is raised temporarily along grooves 61. Once the lower part has been filled, the upper section of mold piece 70 is released so that its lower edge rests again on the upper edge of the first section. Then, the filling device is brought to the top of the column and the upper half is filled in the same manner as described for the lower section. The purpose of filling the column in two or more separate states is to prevent the presence of unfilled air pockets which, given the small section of the columns, would be present should the column be filled from its top in one only operation. A dowel imbedded in the floor slab and pointing upward where the column is to rest, strengthens the union between column and foundation. Likewise, a dowel is placed on top of the column to improve the joining of column and tiebeam.

Figure 9:
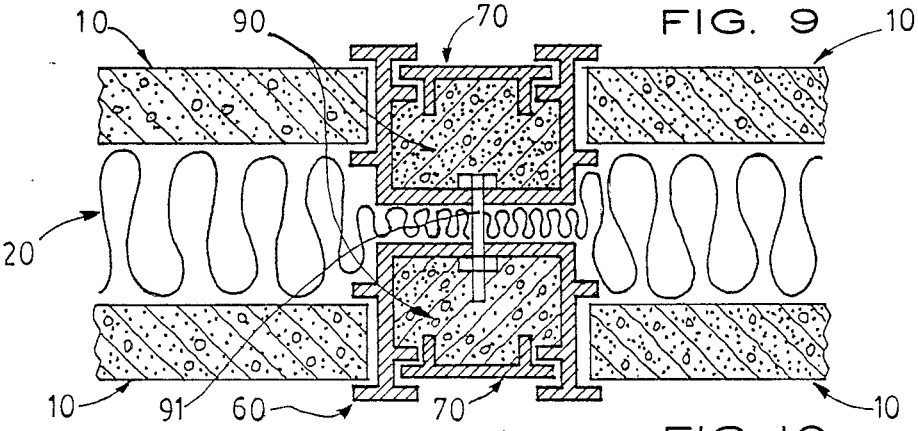
FIG. 9 is a cross section of a composite double column showing four wall panels and insulation joining the same.

Mold piece shown in FIG. 6 has two pairs of flanges 62 symmetrically located in its outer opposite sides, each pair forming a channel 63 where wall panels will be inserted to forming the wall. When only two panels are joining each mold 60 as it is the case in arrangement shown in FIG. 9, cover mold piece 70 is placed with its flanges facing inwards in such a manner that the flat surface 73 of the cover becomes the outer finish of the column. The assembly of two columns with an appropriate fastening device 91 becomes the composite column 90. The fastening device 91 is of a length that will determine the separation between the single columns.

Figure 10:
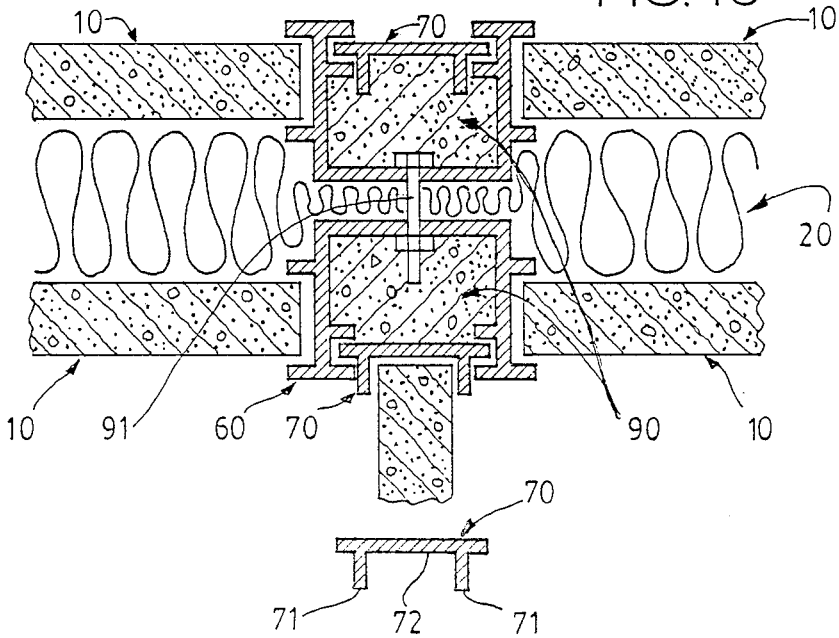
FIG. 10 is a cross section of a composite double column showing five wall panels and insulation joining the same. This arrangement occurs when a composite double wall is combined with a single wall partition.

Shown in FIG. 10 is the arrangement provided for a third wall panel joining the column as a part of a single wall meeting perpendicularly the composite double wall. In this arrangement, cover mold 70 is placed with flanges 71 facing outwards in such a way that the third wall panel 10 is inserted in the channel 72 formed by the pair of flanges 71 of the cover piece 70.

Shown in FIG. 8 is cover mold piece 80 which is identical to cover mold piece 70 except for a prepunched opening 82 provided in cover mold 80 where the electrical box 83 for the electrical outlets and switches will be attached. Cover piece 80 is used in columns provided with electrical conduits and boxes 83. The installation procedure for cover mold piece 80 is the same as for cover mold piece 70. When sections of cover mold 80 are slid downwards along grooves 62 of mold piece 60, the electrical boxes and conduit 83 have already been fastened to mold 80 between flanges 81. When concrete is poured to fill the column section where cover mold piece 80 is installed, the electric box and conduit remain cast in their final position in the construction.

Figure 11:
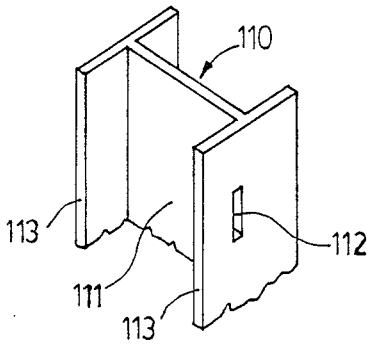
FIG. 11 is an isometric view of the metal piece used to connect adjacent panels when regular column is not required or used.
Figure 12:
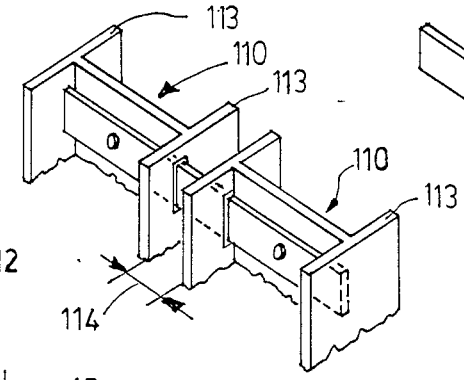
FIG. 12 is an isometric view of metal pieces shown in FIG. 11 assembled to be used in a composite double wall.
Figure 13:
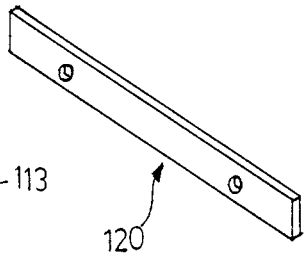
FIG. 13 shows the tying plate used to join the connecting metal pieces shown in FIG. 11.

FIG. 11 shows an isometric projection of piece 110, made of noncorrodible metal or any other appropriate strong noncorrodible material, which is used to join panels 10 when no standard composite column 90 is needed for structural purposes. Piece 110 is I-shaped forming two opposite channels 111 where panels 10 are inserted. The flanges 113 forming the channels have prepunched openings 112 in whatever quantities and positions are required in each specific arrangement, to allow for the passage of connecting plate 120 that ties two or more I-shaped pieces 110 for the assembling of composite walls, as shown in FIG. 12. Connecting plate 120, seen in FIG. 13, is fastened to the bottom of the channel 111 of piece 110 allowing for setting variable and predetermined separations between pieces 110, in accordance with the specifications of the composite wall to be constructed.

Figure 14:
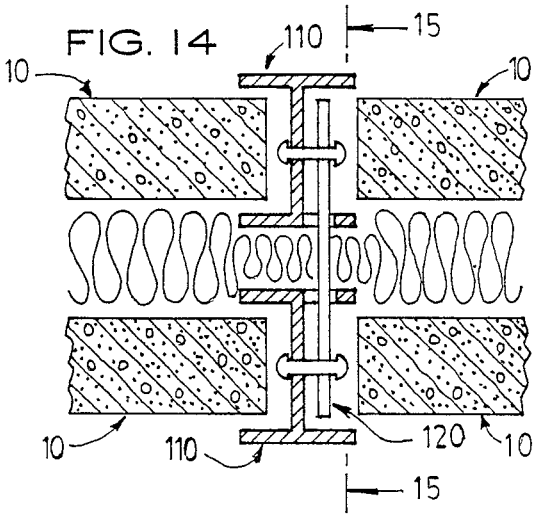
FIG. 14 is a cross section of a composite connecting metal piece shown in FIG. 11, showing four wall panels and insulation joining the same.
Figure 15:
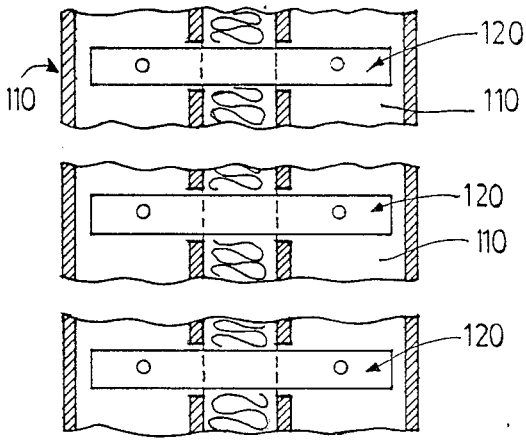
FIG. 15 is a side view along line 15—15, FIG. 14, of the composite connecting metal piece showing the assembly of the elements of the metal parts.

FIG. 14 is a plan section of a composite double wall illustrating the arrangement of metal pieces 110, connecting plate 120, panels 10, and insulation 20. FIG. 15 is a section along line 15—15 of FIG. 14. Plates 120 are spaced at different heights, as shown in FIG. 15, in accordance with the specifications of the composite wall.

Figure 16:
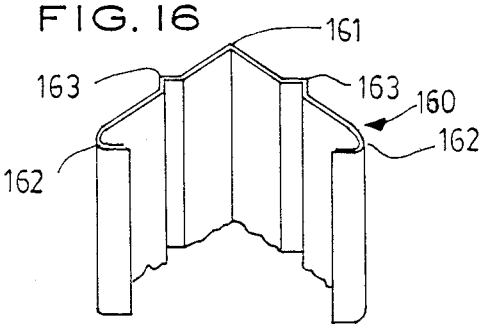
FIGS. 16 and 17 are isometric views of portions of two different mold pieces for fabricating of corner columns in the composite double wall arrangement.
Figure 17:
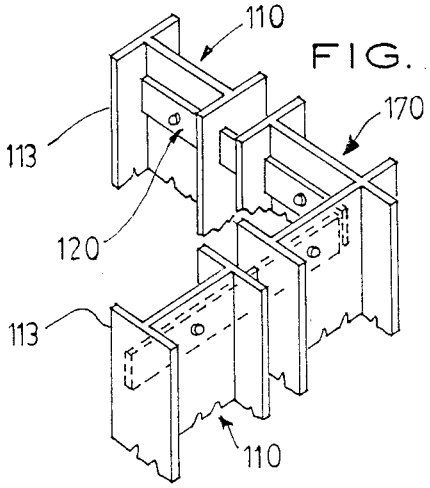
Figure 18:
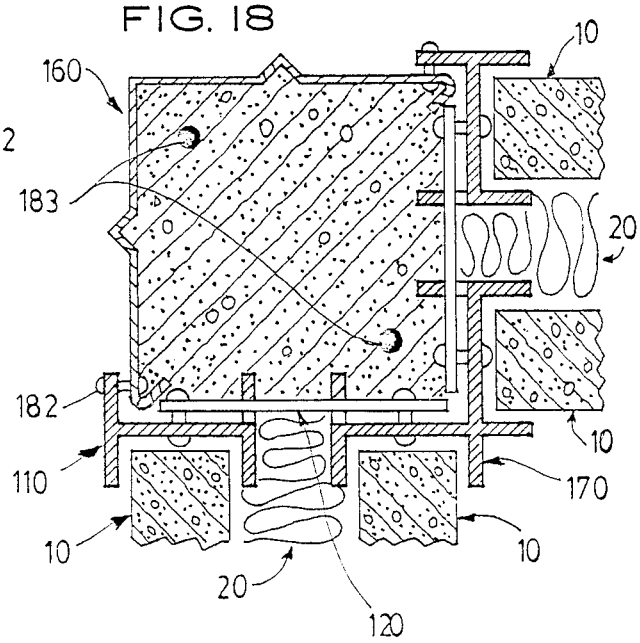
FIG. 18 is a cross section of a corner column in the composite double wall arrangement.

FIGS. 16 and 17 present isometric views of mold pieces 160, 110 and 170 used for fabricating the corner column in the composite double wall arrangement. Mold pieces 110 and 170 are made of extruded aluminum or other appropriate noncorrodible material. Mold piece 160 is made of galvanized steel or other appropriate noncorrodible material. Piece 160 is bent at a 90 degree angle at its outside corner 161. Its edges 162 are bent at approximately 45 degree angles. Mold piece 160 may have lengthwise ribs 163 in the two sides for added strength and rigidity. The column mold ensemble, as shown in FIG. 18, is completed with two mold pieces 110 and one mold piece 170 tied together by means of plates 120. The edges of mold piece 160 are fastened 182 to flanges 113 of mold pieces 110 to complete the mold, or shell, of the corner column. The mold is then placed in its final position in the wall under construction; panels 10 are slid into position, and insulation 20 (or other appropriate material) is also introduced in the composite wall between panels. Reinforcing and anchorage steel 183 is placed within the empty column, and concrete or other appropriate strong hardenable filling material is poured in. Once the concrete has set, metal molds 110, 160 and 170 remain as an integral part of the column.

Figure 19:
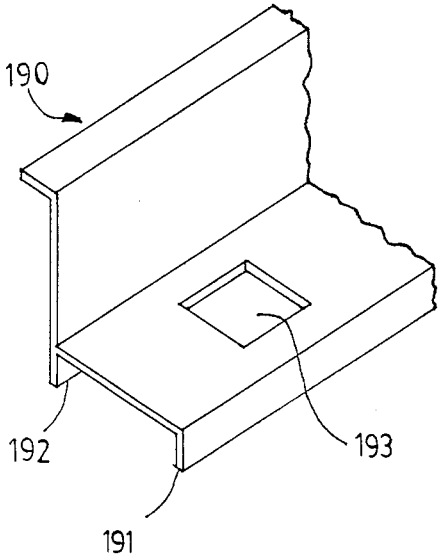
FIG. 19 is an isometric view of a portion of the metal mold piece for fabricating a tie beam on top of the composite double wall.
Figure 20:
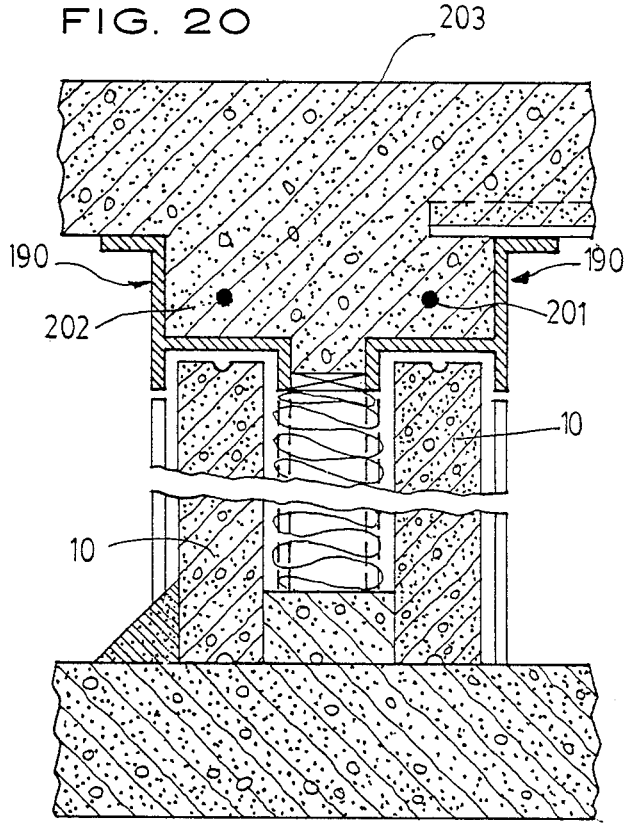
FIG. 20 is a cross section, along line 20—20 of FIG. 4, showing the tie beam, the metal mold pieces, the wall panels, the confined insulation, and the roof slab and metal decking in a composite double wall arrangement in a building.
Figure 21:
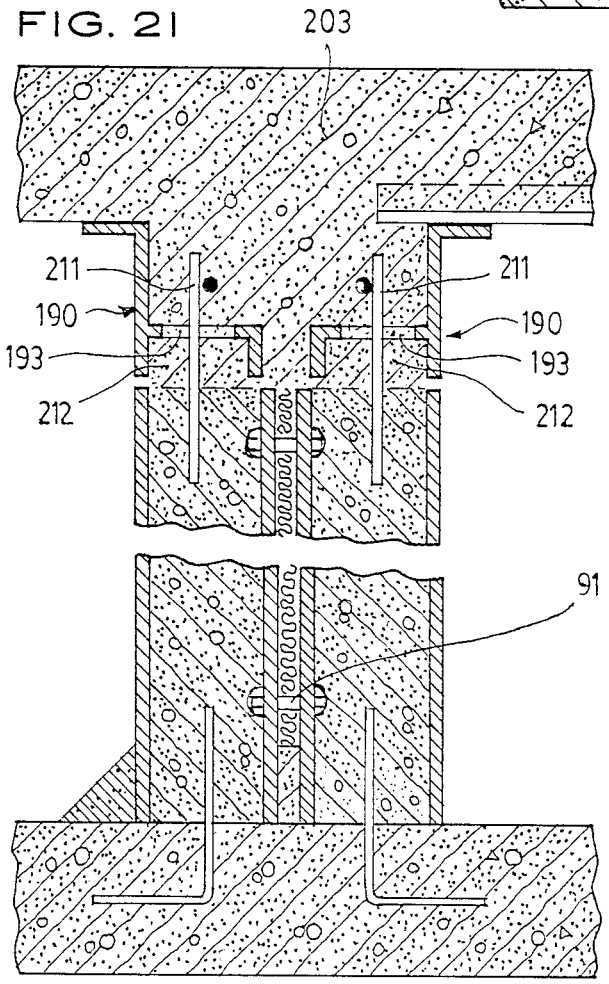
FIG. 21 is a cross section of the tie beam along line 21—21 of FIG. 4, showing the tie beam, the metal mold pieces, the composite double column, the confined insulation, and the roof slab and metal decking in a composite double wall arrangement in a building.

Tiebeams on composite double walls are fabricated by using a mold as shown in isometric projection FIG. 19, and further illustrated in FIGS. 20 and 21. Mold piece 190 has the appropriate length and width and consists of a substantially L-shaped form made of noncorrodible material, having downward flanges 191 and 192 creating a recess where panels 10 are inserted, as shown in FIG. 20. Two molds 190 facing each other are placed on top of panels 10, as it is depicted in FIG. 20 and are kept in place by any appropriate mechanical means, prior to placing reinforcing steel rods 201 and to pouring concrete in the U-shaped trough formed by the two mold pieces 190. In practice, when erecting a building with concrete roof, the tiebeam is filled with concrete 202 when concrete is poured in to fabricate roof slab 203. Once the concrete has set, molds 190 become an integral permanent part of the beam.

FIG. 21 illustrates the manner in which the tiebeam becomes integrated with the composite column 90 upon pouring the concrete to fabricate the beam. Mold piece 190 is provided with prepunched openings 193 spaced in such a way as to coincide with the top of the columns 90. The dowels 211, embodied into the column 90 pass through openings 193. When concrete is poured to form the beam, it descends through opening 193 thus filling the empty space 212 between the top of column 90 and the base of mold piece 190. Dowels 211 act as the tying link between beam and column.

Figure 22:
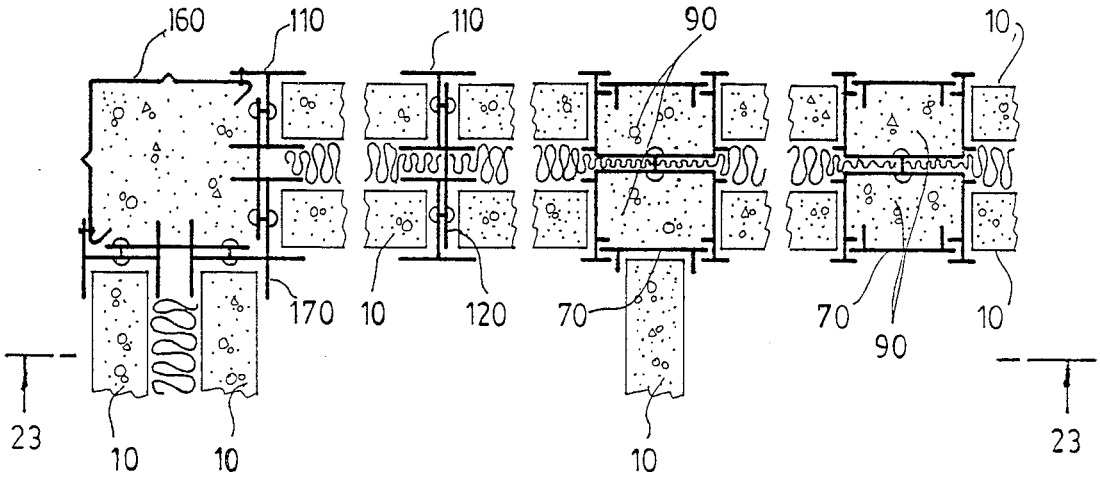
FIG. 22 is a cross section of a plan view of the composite double wall showing several of the elements presented in this description of the drawing in their assembled position.
Figure 23:
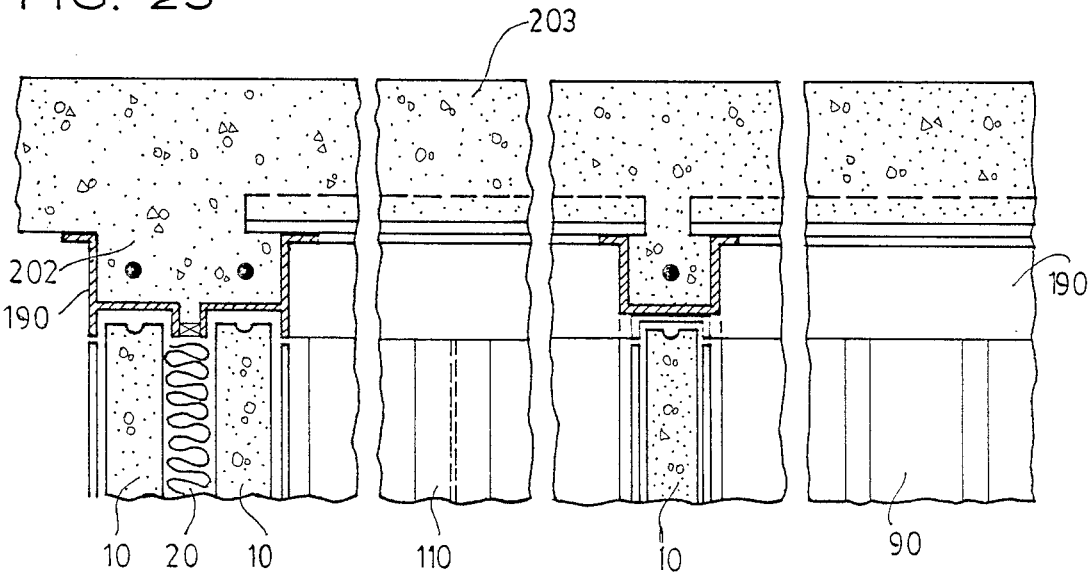
FIG. 23 is a section of the plan view shown in FIG. 22 taken along line 23—23.

FIGS. 22 and 23 further illustrate the position and function of some of the elements described in this section.

FIG. 24 shows a cross-section of a post-tensioned composite double wall assembly used in combination with connecting pieces 110. This embodiment is applied when the double wall section is intended to bear permanent overloads and there are no other specific reasons to use the composite column 90 shown in FIG. 9.

FIG. 25 shows a plan section of said arrangement in the composite double wall along line 25—25 of FIG. 24.

The post-tensioning rod 240 is bent at its lower end 241 and is imbedded in the floor slab thus providing for a secure anchorage. Rod 240 is positioned between the two single wall panels and as near as feasible to tie-up plate 120. The top end of rod 240 is threaded 243 so that nut 244 can be inserted downward thus tightening plate 245 against the upper horizontal surfaces of beam mold pieces 190 which, in turn, exert a downward pressure against wall panels 10. Once nut 244 has reached its lowest point, the tiebeam is completed by pouring concrete in.

The remaining elements of this arrangement are as shown and described in FIG. 14. The elements used in the post-tensioning arrangement can be a steel rod, as described in this preferred embodiment, or any other of the usual elements available in the marketplace for this or similar purposes.

While this invention has been described and illustrated with respect to a certain example which gives satisfactory results, it will be understood by those skilled in the art after understanding the principle of this invention, that various other changes and modifications may be made without departing from the spirit and scope of the invention.

What is claimed is:

1. An improved composite wall comprising the combination of:

a first generally flat vertical wall formed of a plurality of first planar panels arranged with the panel edges fitted together along horizontal edges;

a second general flat vertical wall formed of a plurality of second planar panels arranged with the panel edges fitted together along horizontal edges;

said first and second walls being horizontally spaced from each other forming an aperture therebetween for receiving insulation;

a pair of one piece vertical elongated columns arranged in parallel and spaced from one another forming an aperture between facing column sides;

vertical elongated outwardly opening channels positioned on opposite faces of each of said columns and positioned for receiving end edges of a plurality of the planar panels which comprise said first and second walls;

said apertures between said first and second walls and between said columns combining to form a continuous aperture extending along said walls and columns; and vertically spaced connecting members attaching columns together.

2. The composite wall as claimed in claim 1 which further comprises hollow centers in said elongated columns filed with concrete-like material.

3. The composite wall as claimed in claim 1 which further comprises a generally U-shaped upwardly facing tie beams positioned on the tops of the walls.

4. The composite wall as claimed in claim 1 in which said planar panels comprise molded panels.

* * * * *